US008102110B2

(12) United States Patent
Sekiguchi et al.

(10) Patent No.: US 8,102,110 B2
(45) Date of Patent: Jan. 24, 2012

(54) LAMP WITH OUTER BULB

(75) Inventors: Tsugio Sekiguchi, Saitama (JP); Yasushi Sasai, Saitama (JP); Kanae Matsumoto, Saitama (JP)

(73) Assignee: Iwasaki Electric Co., Ltd., Tokyo (JP)

( * ) Notice: Subject to any disclaimer, the term of this patent is extended or adjusted under 35 U.S.C. 154(b) by 36 days.

(21) Appl. No.: 12/699,195

(22) Filed: Feb. 3, 2010

(65) Prior Publication Data

US 2010/0194260 A1 Aug. 5, 2010

(30) Foreign Application Priority Data

Feb. 4, 2009 (JP) ..... 2009-24154
Feb. 12, 2009 (JP) ..... 2009-29560

(51) Int. Cl.
*H01J 5/48* (2006.01)
*H01J 61/34* (2006.01)

(52) U.S. Cl. ..... 313/318.01; 313/318.05; 313/318.07; 313/318.08; 313/318.12; 313/25

(58) Field of Classification Search ..... None
See application file for complete search history.

(56) References Cited

U.S. PATENT DOCUMENTS 5,023,506 A * 6/1991 Canale et al. ..... 313/25
5,220,235 A * 6/1993 Wakimizu et al. ..... 313/25
6,274,973 B1 * 8/2001 Mochiduki et al. ..... 313/318.09
2002/0063529 A1 * 5/2002 Fukai et al. ..... 313/623
2009/0206753 A1 * 8/2009 Kakisaka ..... 313/634
2009/0278435 A1 11/2009 Sasai et al.
2010/0007264 A1 1/2010 Sasai et al.

FOREIGN PATENT DOCUMENTS

JP 06-251756 * 9/1994
JP 312481 7/2006

* cited by examiner

*Primary Examiner* — Ashok Patel
(74) *Attorney, Agent, or Firm* — Greenblum & Bernstein P.L.C.

(57) ABSTRACT

A lamp with an outer bulb in which a base (30) includes a base main body (32) having a contact terminal (31) electrically connected with a receptacle and an attaching member (33) fitted to the base main body (32) in a state of retaining the lamp main body (10) and an outer bulb (20), the attaching member (33) has an insertion hole (34) formed therethrough for inserting and retaining a pinch seal (14), and a flange (36) for abutment with the opening end (21) of the outer bulb formed at the outer peripheral surface (35) thereof, and a joint portion (40) is formed for engaging the outer peripheral surface of the attaching member (33) and the inner peripheral surface (23) of the outer bulb (21). An adhesive injection port (38) is opened to the bottom of the attaching member for filling the adhesive to the joint portion (40) in a state of mounting the outer bulb, thereby improving the commercial value by making the adhesive deposited to the insertion hole portion invisible externally, as well as preventing the outer bulb from detachment and mitigating inventory control depending on the type of the bases.

5 Claims, 16 Drawing Sheets

LAMP WITH OUTER BULB

TECHNICAL FIELD

The present invention concerns a lamp with an outer bulb in which an outer bulb for housing a lamp main body is attached with an aim, for example, of protecting the lamp main body against external damages, preventing scattering of flakes due to bursting and breakage of the lamp main body and suppressing and decreasing emission of UV-ray harmful to human bodies.

BACKGROUND ART

The lamp of the type described above includes, for example, a metal vapor discharge lamp such as a metal halide lamp in which a lamp main body comprising a light emitting tube or a lamp main body comprising a light emitting tube and an airtight bulb containing the same is housed in an outer bulb that constitutes an outer shell of the lamp, and a halogen lamp in which a lamp main body having a light emitting filament and an airtight bulb containing the same is housed in an outer bulb that constitutes an outer shell of the lamp.

The existent lamp 61 with the outer bulb described above has a lamp main body 66, an outer bulb 67 housing the main body, and a base 68 attached on one end thereof as shown in FIGS. 14 and 15.

In the lamp main body 66, a light emitting tube 62 is contained in an airtight bulb 64 which is hot press bonded on one end to form a pinch seal 65, and a pair of lead wires 63 of the light emitting tube are led out of the pinch seal 65.

In the base 68, a supporting post 69 is formed for attaching the lamp main body 60 and the outer bulb 67, and a flange 70 for closing the opening end 67*a* of the outer bulb 67 is formed to the outer peripheral surface 69*a* thereof, and an insertion recess 71 for retaining the pinch seal 65 is formed in the supporting post 69.

Further, the supporting post 69 is formed to such a diametrical size that a gap 72 for filling a heat resistant adhesive is formed between the outer peripheral surface 69*a* thereof and the inner peripheral surface 67*b* of the outer bulb 67 opposed to the outer peripheral surface of the supporting post 69.

When the lamp 61 is assembled, in order that the lamp main body 66 does not tilt in a state of inserting the pinch seal 65 of the lamp main body 66 to the insertion recess 71 of the supporting post 69, a heat resistant adhesive A is filled in a gap between them and deposited over the upper surface of the supporting post 69, as shown in FIG. 16A.

Then, after depositing the heat resistant adhesive A sufficiently over the outer peripheral surface 69*a* of the supporting post 69, the outer bulb 67 is fitted externally so as to scrape off the peripheral surface of the adhesive A as shown in FIG. 16B, and the outer bulb 67 is fitted externally such that the opening end 67*a* is closed by the flange 70 of the supporting post 69, thereby filling the adhesive in the gap 72 as shown in FIG. 16C.

However, since the outer bulb 67 is transparent and the adhesive A deposited over the upper surface of the supporting post 69 is visible externally, the appearance is disfigured to worsen the commercial value.

For concealing the adhesive, a lamp with an outer bulb formed with an opaque film to the outer bulb has been proposed (refer to Patent Document 1).

In the lamp with the outer bulb, an opaque film that conceals the adhesive filled in the gap 72 is formed to the base end (near the opening end 67*a*) of the outer bulb 67.

However, since the base end of the outer bulb 67 is exposed to high temperature during lighting of the lamp and cooled to a room temperature when the lamp is turned off, it undergoes violent temperature change.

Accordingly, the opaque film has to be formed by using a heat resistant material having an adhesion strength to such an extent as not peeling from the surface of the outer bulb even when it is exposed to temperature change (high anchorage). For example, it is necessary to dip the outer bulb in an alumina-silica type heat resistant coating material, to coat the material to the inner peripheral surface or the outer peripheral surface and then bake the coating at a high temperature. Then, this requires not only the step of coating the heat resistant coating material but also requires a baking step.

Then, in a case of additionally installing a firing furnace for film formation in the production line for lamps or outer bulbs, this not only increases the installation cost but also results in a trouble that an installation space has to be ensured, for example, by displacing existent facilities. Even if an existent firing furnace can be utilized, it still needs an operation of re-arranging the conveying path in the line.

Further, since the baking step is additionally provided in any case, this results in a problem of being contrary to the social demand for energy saving and increasing the production cost and lowering the production efficiency.

Further, aside from the formation of the opaque film, while the inner peripheral surface 67*b* of the outer bulb 67 and the outer peripheral surface 69*a* of the supporting post 69 are secured by means of the adhesive A, the adhesion strength is lost by aging deterioration of the adhesive to even bring about a worry that the outer bulb 67 may possibly be detached when it is mounted with the end thereof on the side of the base 68 being directed upward.

Further, there are various kinds of bases for the lamps of the above mentioned type depending on the shapes of receptacles and it is necessary for assortment of plural kinds of bases even for lamps of an identical specification. Then, there has been a requirement for controlling inventory stocks of lamps with the outer bulb which are to be attached with respective kinds of bases.

Accordingly, there has been a problem that stocks of lamps with the outer bulb mounted with a certain kind of base may cause short age, whereas thereof lamps with the outer bulb mounted with other kind of bases may be overstocked.

PRIOR ART DOCUMENT

Patent Document

[Patent Document 1]
Japanese Utility Model Registration No. 3124181

SUMMARY OF THE INVENTION

Subject to be Solved by the Invention

In view of the above, the present invention intends for enhancing the appearance and improving the commercial value of lamps by making the adhesive deposited over the pinch seal invisible externally and, at the same time, preventing detachment of the outer bulb and, further, mitigating troublesome stock control depending on the kinds of the bases.

Means for Solving the Subject

For solving the subject described above, the present invention intends to provide a lamp with an outer bulb in which a lamp main body formed with a pinch seal by hot press bonding one end of an airtight bulb having a pair of lead wires led out therefrom is attached in a state housed in the outer bulb to a base, wherein the base includes a base main body having contact terminals electrically connected with a receptacle and an attaching member fitted to the inside of the base main body in a state of retaining the lamp main body and the outer bulb, the attaching member has an insertion hole formed therethrough for inserting and retaining the pinch seal and has a flange formed at the outer peripheral surface thereof for abutment with the opening end of the outer bulb end, a joint portion is formed for engaging the outer peripheral surface of the attaching member and the inner peripheral surface of the outer bulb, and an adhesive injection port is opened in the bottom of the attaching member opposed to the base main body for filling an adhesive to the joint portion in a state of attaching the outer bulb.

Advantageous Effects of the Invention

According to the present invention, when the adhesive is injected from the bottom of the attaching member to the insertion hole in a state of inserting the pinch seal of the lamp main body to the insertion hole of the attaching member and abutting the opening end of the outer bulb against the flange, the adhesive is filled in the insertion hole to secure the lamp main body to the attaching member and, when the adhesive is injected from the adhesive injection port to the joint portion, the outer bulb is secured.

In this case, since the adhesive for securing the main body is filled from the bottom of the attaching member into the insertion hole, it can be filled without overflowing to the outside of the insertion hole and, accordingly, the adhesive is invisible externally.

Further, since the adhesive is filled in the joint portion, the outer peripheral surface of the attaching member and the inner peripheral surface of the outer bulb are engaged to each other.

As described above, a partially completed lamp product in which the lamp main body and outer bulb are secured to the attaching member and the base main body is not yet mounted is formed.

Then, a lamp with an outer bulb is completed by depositing an adhesive to the inside of the base main body, connecting lead wires of the lamp main body to the contact terminals, and fitting the attaching member to the base main body.

As described above, the step of assembling the partially completed lamp product and the step of mounting the base main body can be isolated. Then, when inventory goods are stored in a state of the partially completed products not yet mounted with the base, since base main bodies of any optional type can be mounted on every quantity conforming to an order, no wasteful loss is caused for inventory stocks.

In the completed lamp with the outer bulb, since the adhesive for securing the lamp main body to the attaching member is not visible externally, and also the adhesive for the joint portion that secures the outer bulb is only slightly visible externally, it has good appearance in view of design and high commercial value.

Further, since the attaching member is secured to the base main body by means of the adhesive, the lead wires of the lamp main body are electrically connected with the connection terminals, and the outer bulb and the attaching member are engaged to each other by way of the joint portion, the outer bulb or the attaching member attaching the same is not detached from the base main body even when they are attached with their end on the side of the base end being directed upward.

Particularly, in an embodiment where the joint portion includes a concave portion or a convex portion formed to the outer peripheral surface of the attaching member and the inner peripheral surface of the outer bulb respectively while facing the gap formed between the outer peripheral surface of the attaching member and the inner peripheral surface of the outer bulb opposed thereto, and a joint which is cast in-mold by the adhesive filled in the gap, since the joint is engaged to the attaching member and the outer bulb, the outer bulb is not detached from the attaching member or the base main body.

Further, in an embodiment where the joint portion constitutes a bayonet mechanism comprising an engaging concave portion formed to the outer peripheral surface of the attaching member and a convex portion formed to the outer bulb, since the attaching member and the outer bulb are engaged directly and the adhesive is filled therein, the outer bulb is not detached from the attaching member or the base main body.

DESCRIPTION OF EMBODIMENTS

Figure 1:
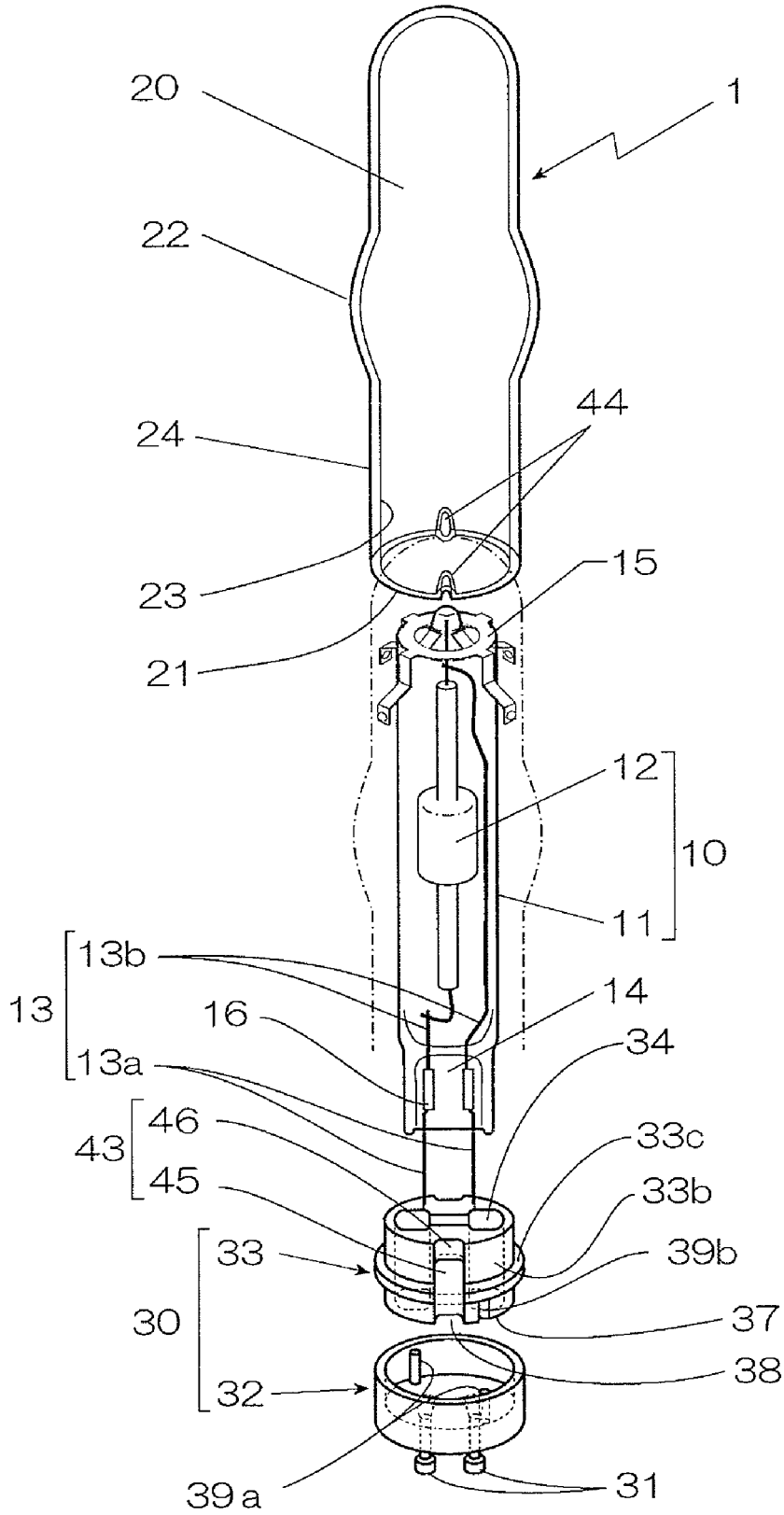
FIG. 1 is an exploded perspective view showing an embodiment of a lamp with an outer bulb according to the invention.

In the present invention, for attaining the purpose of improving the appearance and enhancing the commercial value by making an adhesive deposited to a supporting post invisible externally without additionally forming an opaque film to an outer bulb, as well as preventing detachment of the outer bulb, a base includes a base main body having contact terminals electrically connected with a receptacle and an attaching member for retaining a lamp main body and the outer bulb, the attaching member is formed such that it can be fitted to the inside of the base main body and has an insertion hole formed therethrough for inserting and retaining a pinch seal, a flange for abutment with the opening end of the outer bulb is formed to the outer peripheral surface of the attaching member, a joint portion is formed for engaging the outer peripheral surface of the attaching member and the inner peripheral surface of the outer bulb to each other, and an adhesive pouring port is opened in the bottom of the attaching member opposed to the base main body for filling an adhesive to the joint portion in a state of mounting the outer bulb.

Example 1

The present invention is to be described by way of preferred embodiments shown in the drawings.

FIG. 1 to FIG. 4 show a first embodiment of the present invention.

Figure 2:
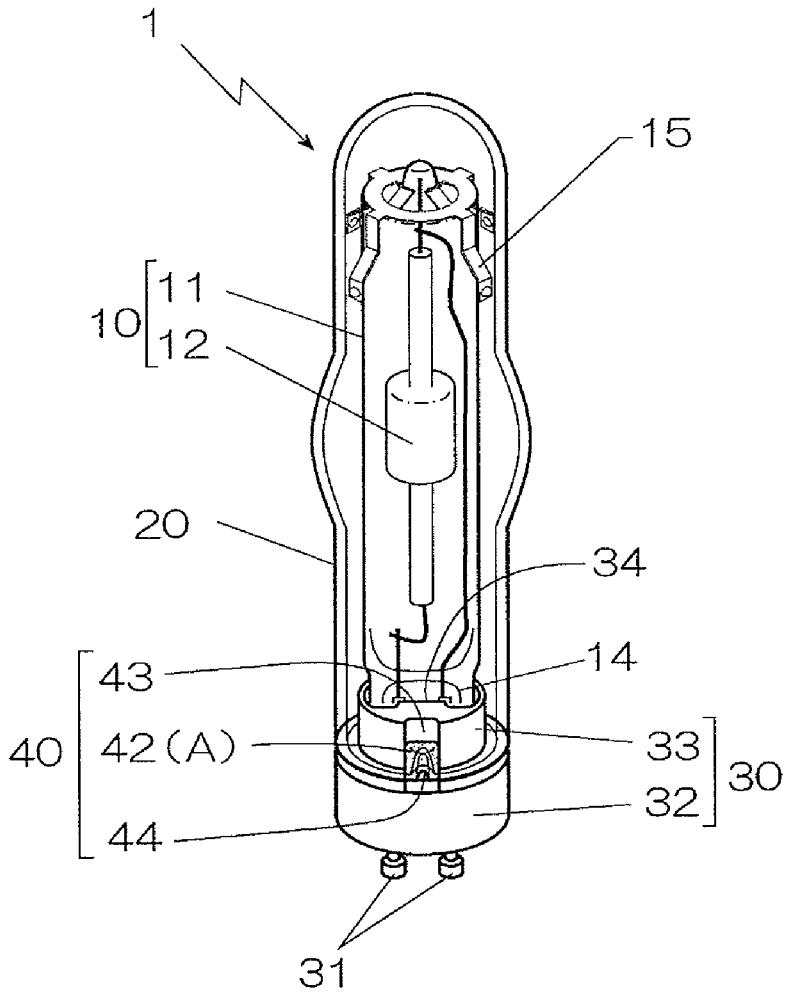
FIG. 2 is a completed perspective view thereof.

In a lamp 1 with an outer bulb shown in FIG. 1 and FIG. 2, a lamp main body 10 having a light emitting tube 12 such as a ceramic metal halide lamp housed in an airtight bulb 11 made of glass is attached to a base 30 in a state housed in an outer bulb 20.

In the lamp main body 10, an airtight bulb 11 from which a pair of lead wires 13, 13 are led out is hot press bonded to form a pinch seal 14 on the side of the base end thereof and mounted with a support 15 formed of a leaf spring at the top end thereof for positioning the lamp main body 10 at the center of the outer bulb 20.

For connecting external lead wires 13*a* led out from the pinch seal 14 and internal leads 13*b* connected with the light emitting tube 12 in the airtight bulb 11, molybdenum foils 16 are welded to both of the leads 13*a* and 13*b*.

Figure 12:
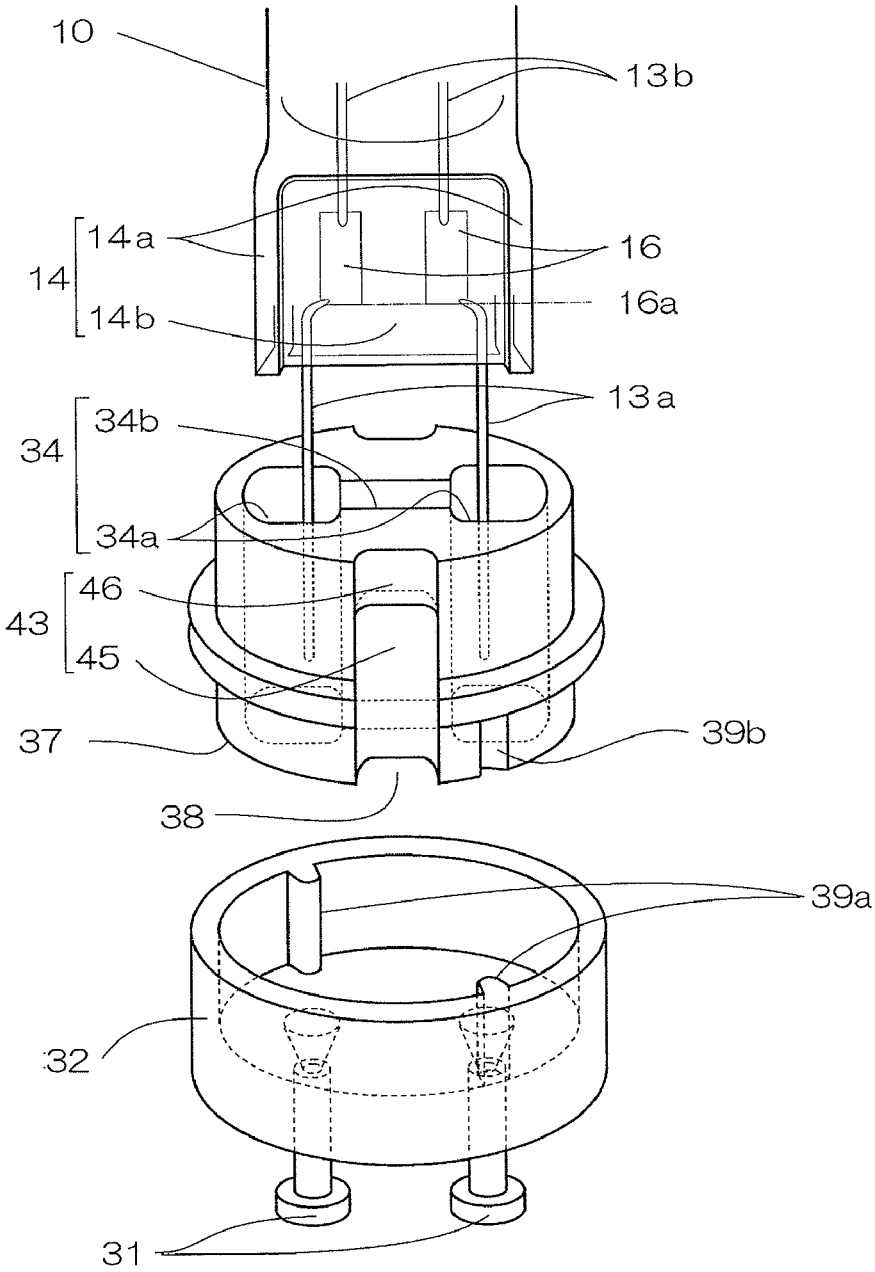
FIG. 12 is an enlarged view showing a main portion thereof.

The pinch seal 14 is formed into an I-cross sectional shape comprising flanges 14*a*, 14*a* on both right and left sides and a flat plate portion 14*b* therebetween, and the molybdenum foils 16 are airtightly sealed in the flat plate portion 14*b* (refer to FIG. 12).

The outer bulb 20 is formed of a glass bulb, which is opened at one end to form an opening end 21 and closed at the other end into a semi-spherical shape and bulged into a large diametrical portion near the light emitting portion of the light emitting tube 12.

The base 30 comprises a base main body 32 having contact terminals 31, 31 electrically connected with a receptacle (not illustrated) of an illumination device, etc., and an attaching member 33 fitted to the inside of the base main body 32 in a state of retaining the lamp main body 10 and the outer bulb 20.

In the attaching member 33, an insertion hole 34 for inserting and retaining the pinch seal 14 is formed therethrough, a flange 33*c* for abutment with the opening end 21 of the outer bulb is formed at the outer peripheral surface 33*b*, and a joint portion 40 is formed for engaging the outer peripheral surface 33*b* and the inner surface 23 of the outer bulb 20 to each other.

Further, engaging grooves 39*b* are formed at the outer peripheral surface on the bottom of the attaching member 33 for engaging ribs 39*a* formed to the base main body 32 such that the attaching member 33 does not rotate relative to the base main body 32.

The joint portion 40 is disposed along the peripheral direction of the outer bulb 20 and the attaching member 33 at two positions thereof diametrically opposing each other and comprises a concave portion or a convex portion formed to the outer peripheral surface 33*b* of the attaching member 33 and the inner peripheral surface 23 of the outer bulb 20 respectively while facing a gap 41 formed between the outer peripheral surface 33*b* of the attaching member 33 and the inner peripheral surface 23 of the outer bulb 20 opposed thereto, and a joint 42 which is cast in-mold by a heat resistant adhesive A filled in the gap 41.

In this embodiment, an engaging concave portion 43 extending in the axial direction is formed to the outer peripheral surface 33*b* of the attaching member 33, and an engaging protrusion (convex portion) 44 formed corresponding to the engaging concave portion 43 is formed to the opening end 21 of the outer bulb 20 to be described later, and the joint 42 is cast in-mold therebetween.

The engaging concave portion 43 is formed more deeply on the side of the bottom and less deeply on the side of the upper surface of the attaching member 33 in which a deep portion functions as an adhesive reservoir 45 that forms the joint 42, and the shallow portion functions as a dam 46 that forms a narrow portion so as not to overflow the adhesive injected from the side of the bottom to the adhesive reservoir 45 toward the upper surface.

Each of the engaging protrusions 44 of the outer bulb 20 is protruded from the inner peripheral surface 23 to the center thereof such that the top end thereof enters into the engaging concave portion 43 and the outer bulb 20 can not be fitted externally over the attaching member 33 when the outer bulb 20 is situated coaxially relative to the attaching member 33 unless the engaging protrusion 44 is aligned with the position for the engaging concave portion 43.

Then, the engaging concave portion 43 of the attaching member 33 is extended by recessing the flange 33*c* as far as the bottom 37, and an adhesive injection port 38 is opened in the attaching member 33 on the side of the bottom 37 thereof such that the adhesive A can be cast into the joint portion 40 in a state of abutting the opening end 21 of the outer bulb 20 against the flange 33*c*.

Figure 3A:
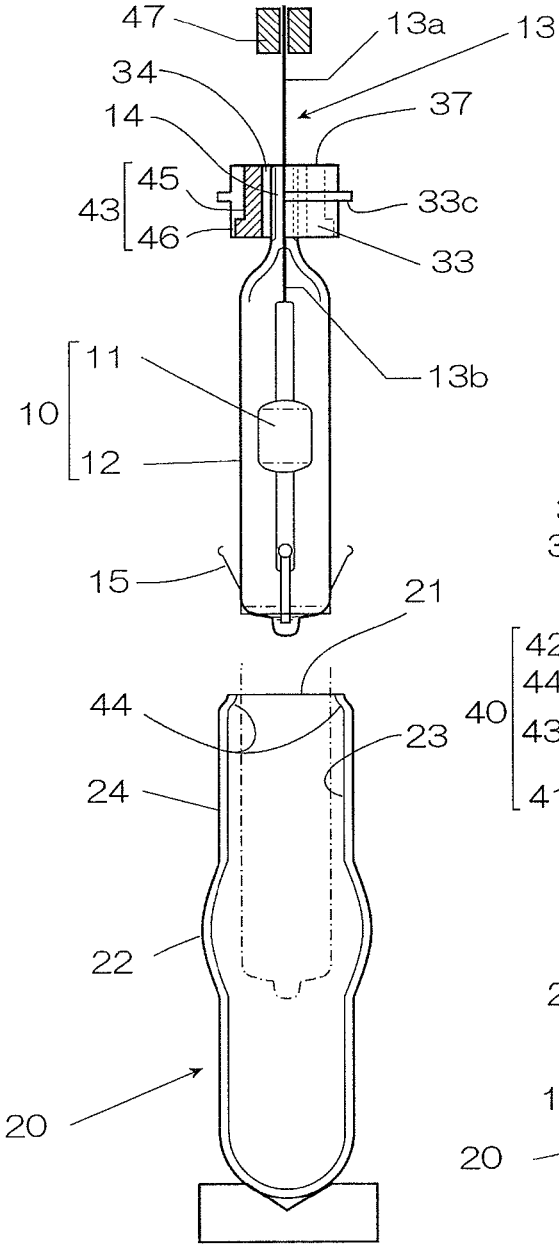
FIG. 3 is an explanatory view showing the step of assembly a light emitting tube and an outer bulb thereof.

When the lamp main body 10 and the outer bulb 20 are assembled, they are assembled as shown in FIG. 3A, by mounting the support 15 to the top end of the lamp main body 10, externally fitting the attaching member 33 to the pinch seal 14 of the lamp main body, clamping the portion of the external lead 13*a* by a clamper 47 with the top end of the lamp main body being directed downward, and situating the same coaxially with the outer bulb 20 which is caused to stand vertically with the opening end 21 being directed upward.

Figure 3B:
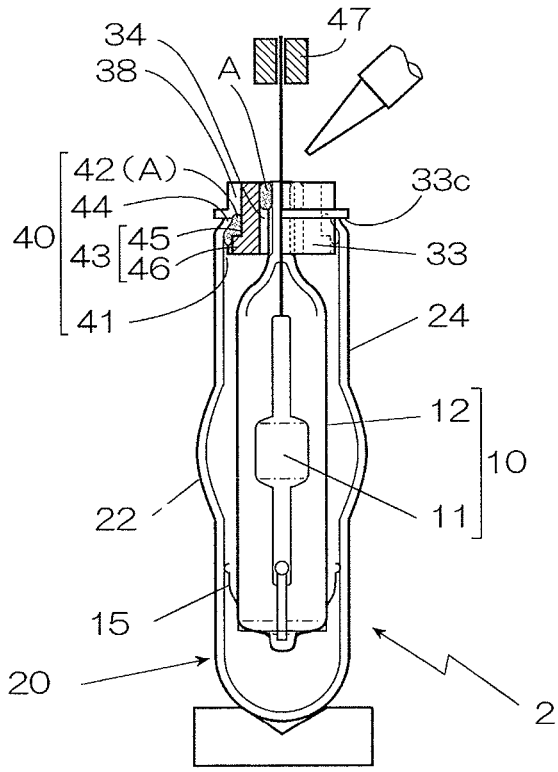

Then, after abutting the flange 33*c* of the attaching member 33 against the opening end 21 of the outer bulb 20, the clamper 47 is further lowered vertically to a position where the distance between the clamper 47 and the flange 33*c* reaches a predetermined size and, as shown in FIG. 3B, the lamp main body 10 is inserted into the outer bulb 20, a heat resistant adhesive A is filled from the bottom of the attaching member 33 into the insertion hole 34, and the adhesive A is filled from the adhesive injection port 38 to the inside of the gap 41.

In this case, since the dam 46 is formed at the upper end of the concave portion 43 which is formed at the outer peripheral surface 33*b* of the attaching member 33 (on the side of the top end of the light emitting tube), the adhesive A cast into the concave portion 43 can be dammed so as not to overflow as far as the upper surface of the attaching member 33.

Further, the joint 42 is formed to such a shape that it is caught by the dam 46 even when the adhesion strength of the joint 42 is lost in a state of suspending the lamp 1 with the end thereof on the side of the base 30 being directed upward.

Further, when the adhesive A cast into the concave portion 43 flows over the convex portion 44 of the outer bulb 20 into the inside of a straight bulb portion 24, since the outer diameter of the attaching member 33 including the thickness of the joint 42 formed of the adhesive A becomes larger than the inner diameter between the top ends of the engaging protrusions 44 formed at the opening end 21, the joint 42 is formed to such a shape that the opening end 21 of the outer bulb 20 is caught thereby even when the adhesion strength of the joint 42 is lost in a state of suspending the lamp 1 with the end thereof on the side of the base 30 being directed upward.

When the lamp main body 10 and the outer bulb 20 are attached to the attaching member 33 as described above, a partially completed product 2 not yet mounted with the base main body 32 is manufactured. When inventory stocks are controlled in this state, since necessary lamps can be manufactured simply by merely mounting base main bodies of any optional specification in accordance with the quantity of products to fill an order, this causes no wasteful inventory stocks.

Finally, the partially completed lamp product 2 is attached to the metal main body 32.

Figure 4A:
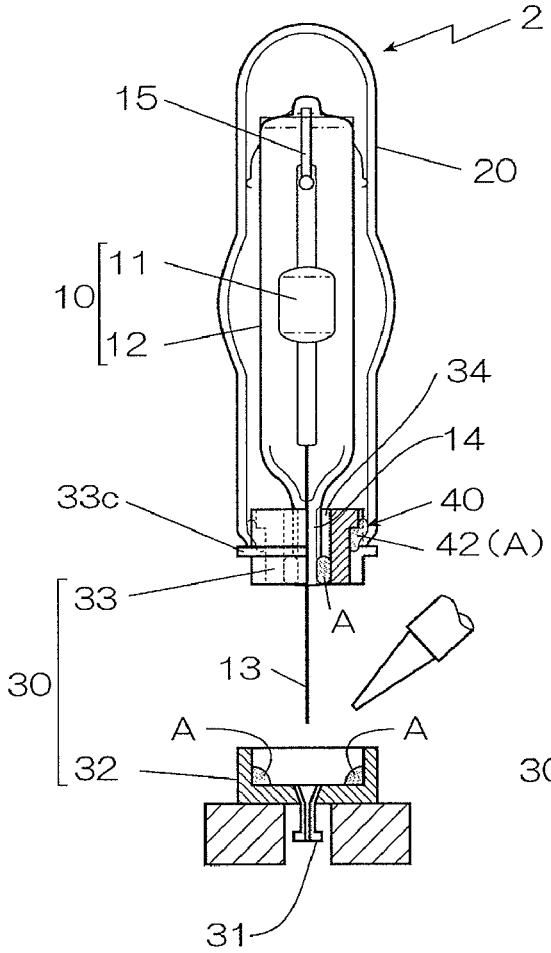
FIG. 4 is an explanatory view showing the step of mounting a base main body thereof.

First, as shown in FIG. 4A, an adhesive A is deposited to two inner corner portions of the base main body 32, the lead wire 13 is clamped downward, and a partially completed lamp product 2 is coaxially arranged with the base main body 32 and lowered vertically.

Figure 4B:
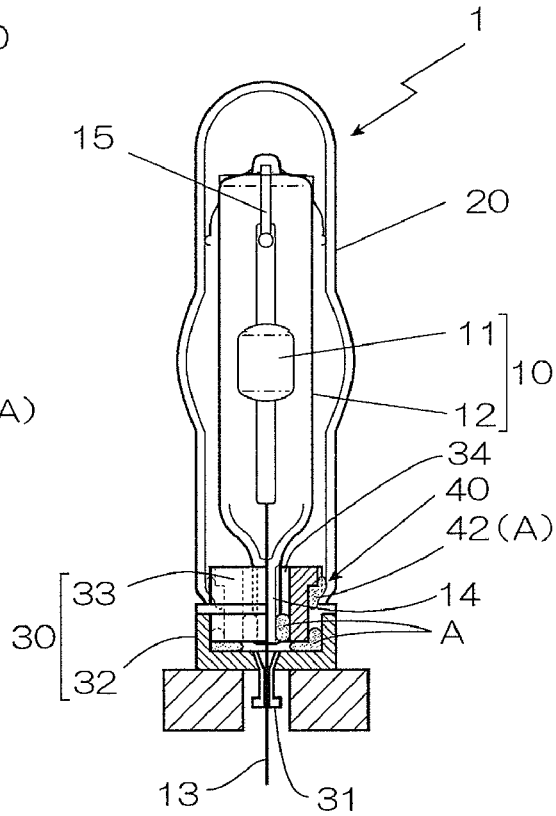

Then, as shown in FIG. 4B, at the instance the flange 33*c* abuts against the opening end of the base main body 32, the base main body 32 and the attaching member 33 are secured by means of the adhesive A.

At the same time, the top end of the lead wire 13 is guided into a contact terminal 31, the lead wire 13 and the contact terminal 31 are electrically connected from the outside by an optional method such as soldering and, when the lead wire 13 extends outward of the top end of the contact terminal 31, the extended portion is cut off to complete assembling.

Figure 6:
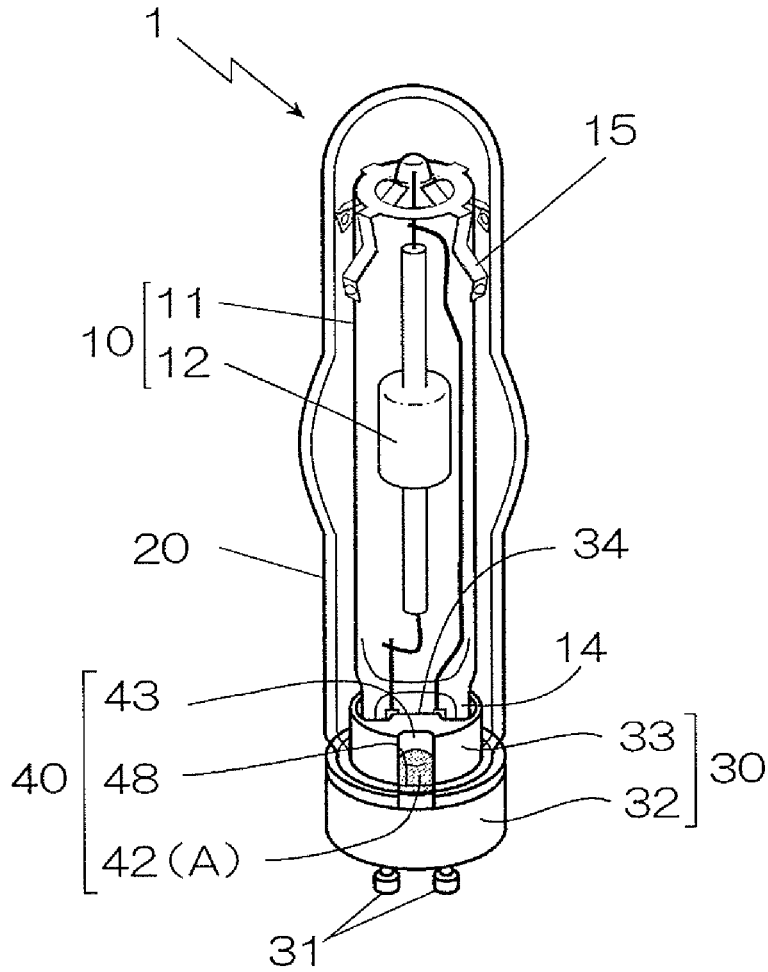
FIG. 6 is a completed perspective view thereof.
Figure 7:
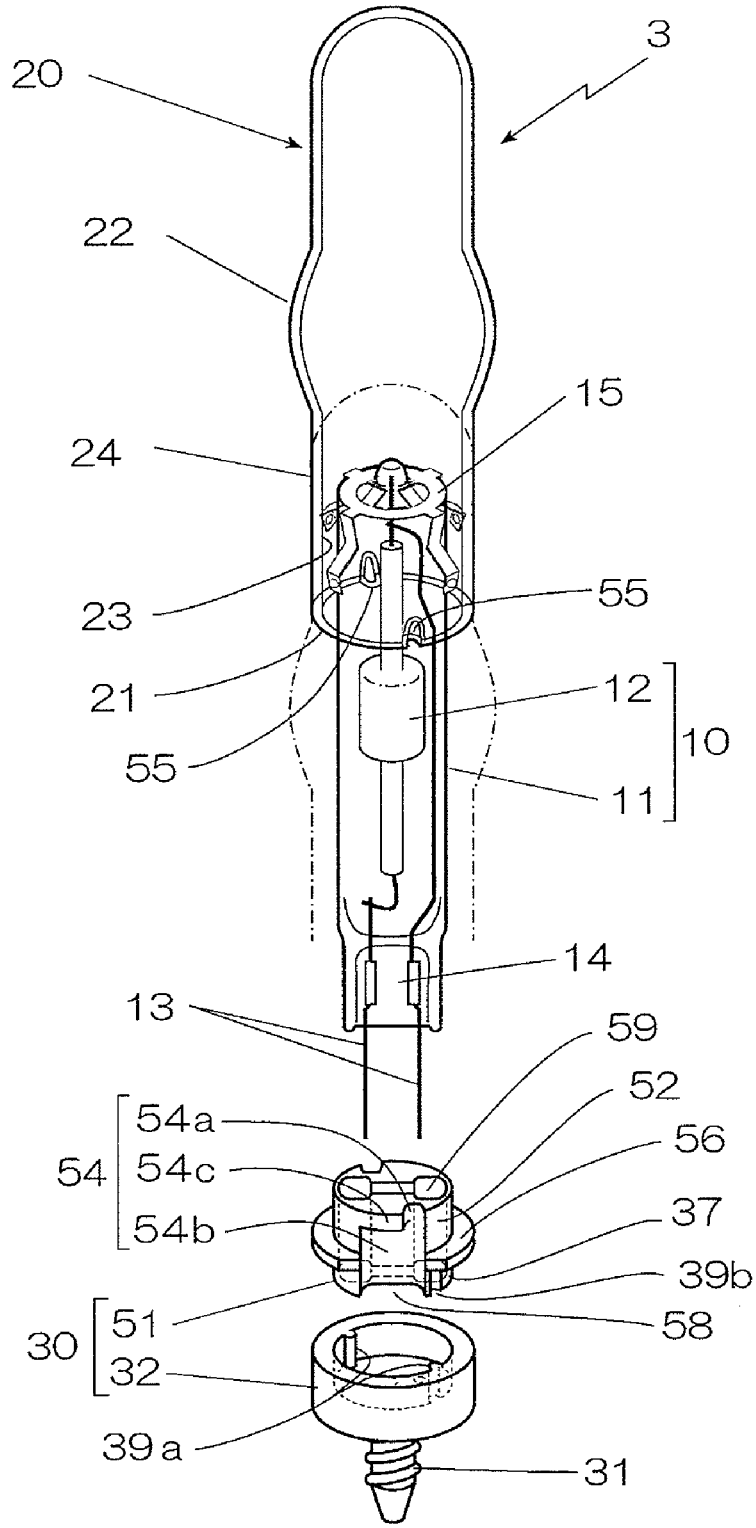
FIG. 7 is an exploded perspective view showing a further embodiment of a lamp with an outer bulb according to the invention.

In the thus assembled lamp 1 with the outer bulb, since the adhesive A filled in the insertion hole 34 for securing the lamp main body 10 is invisible externally and also the adhesive A for securing the outer bulb 20 is visible only for the portion where the adhesive is filled in the concave portions 43 formed at two circumferential positions as the joint 42 as shown in FIG. 6, the lamp 1 is neat in view of the design and has high commercial value.

Further, since the attaching member 33 is secured by means of the adhesive A to the base main body 32, and the lead wire 13 is secured to the contact terminal 31 of the base main body 32 in a state where the pinch seal 14 of the lamp main body 10 is inserted through the insertion hole 34 of the attaching member 33, the attaching member 33 is not detached from the base main body 32.

Further, since the outer bulb 20 is secured by means of the adhesive to the attaching member 33, and the opening end 21 thereof is caught by the joint 42 and the joint 42 is caught at the concave portion 43 of the attaching member 33, the outer bulb 20 is not detached from the base main body when it is mounted in a suspended state with the end thereof on the side of the base 30 being directed upward even if the adhesion strength of the adhesive A is lost.

Example 2

Figure 5:
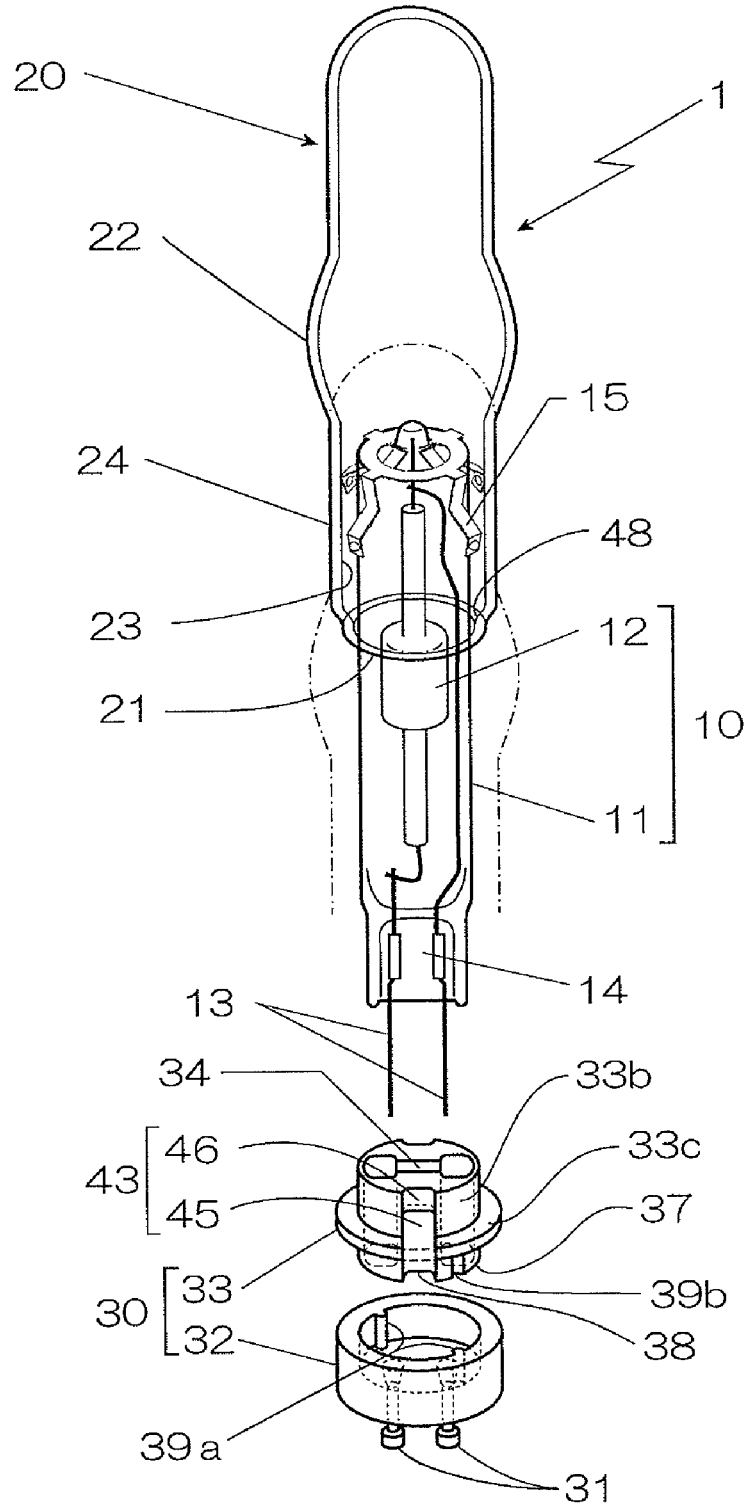
FIG. 5 is an exploded perspective view showing another embodiment of a lamp with an outer bulb according to the invention.

FIG. 5 and FIG. 6 show a second embodiment of the invention in which portions identical with those in FIG. 1 to FIG. 4 carry same reference numerals for which detailed descriptions are to be omitted.

This example is identical with Example 1 except for drawing the opening end 21 of the outer bulb 20 thereby forming an annular convex portion 48 protruding toward the center instead of the engaging protrusions formed at two diametrically opposite positions as the convex portion formed to the inner peripheral surface 23 of the outer bulb 20.

A joint portion 40 comprises an engaging concave portion 43 formed to an outer peripheral surface 33*b* of an attaching member 33, an annular convex portion 48 formed to the inner peripheral surface 23 of the outer bulb 20 while facing a gap 41 formed between the inner peripheral surface 23 of the outer bulb 20 and the attaching member, and a joint 42 which is cast in-mold by means of a heat resistant adhesive A filled in the gap 41.

Also in this example, the engaging concave portion 43 is formed more deeply on the side of the bottom and less deeply on the side of the upper surface of the attaching member 33, in which the deep portion functions as an adhesive reservoir 45 that forms the joint 42, and the shallow portion functions as a dam 46 that forms a narrow portion so as not to overflow the adhesive injected from the bottom to the adhesive reservoir 45 toward the upper surface.

The assembling procedures and the function and the effect are identical with those of Example 1.

Example 3

FIG. 7 to FIG. 10 show a further embodiment of the invention in which portions identical with those in FIG. 1 to FIG. 6 carry same reference numerals for which detailed descriptions are to be omitted.

In a lamp 3 with an outer bulb of this example, a lamp main body 10 having a light emitting tube 12 housed in an airtight bulb 11 made of glass is attached to a base 30 in a state housed in the outer bulb 20 as shown in FIG. 7 to FIG. 10.

The base 30 includes a base main body 32 having contact terminals 31, 31 electrically connected with a receptacle (not illustrated) of an illumination device, etc. and an attaching member 51 fitted to the inside of the base main body 32 in a state of retaining the lamp main body 10 and the outer bulb 20.

Then, in this example, a joint portion 53 for engaging the outer peripheral surface 52 of an attaching member 51 and the inner peripheral surface 23 of the outer bulb 20 to each other is disposed along the circumferential direction of the outer bulb 20 and the attaching member 33 at two diametrically (opposing) positions, and constitutes a bayonet mechanism comprising an engaging concave portion 54 formed to the outer peripheral surface 52 of the attaching member 51 and an engaging protrusion 55 formed to the inner peripheral surface 23 at the opening end 21 of the outer bulb 20 in accordance with the position and the depth of the engaging concave portion 54.

The engaging concave portion 54 comprises a guide groove 54*a* of such a narrow width as capable of axially guiding the engaging protrusion 55 formed to the outer bulb 20 and an engaging groove 54*b* of such a large width as capable of catching the engaging protrusion 55 by the rotation of the outer bulb 20 in the circumferential direction in a state where the engaging protrusion 55 is guided in the guide groove 54*a* and the opening end 21 of the outer bulb 20 is abutted against the flange 56 of the attaching member 51, and the engaging groove 54*b* on the side of the upper surface of the attaching member 51 is formed as a horizontal engaging portion 54*c* that engages the engaging protrusion 55.

Further, the engaging concave portion 54 is extended by recessing the flange 56 as far as the bottom of the attaching member 51, and an opening is formed to the bottom thereof as an adhesive injection port 58 for injecting a heat resistant adhesive A into the joint portion 53.

Then, since the space between the inner peripheral surface 23 of the outer bulb 20 and the engaging concave portion 54 where the adhesive inflows is formed such that the portion on the side of the upper end is formed narrower than that on the side of the adhesive injection port 58 by the guide groove 54*a* and the horizontal engaging portion 54*c*, when the adhesive is injected from the adhesive injection port 58 to the joint portion 53, this provides a structure that the adhesive inflowing to the joint portion 53 less overflows to the upper surface of the attaching member 51.

Figures 9A, 9B, 9C:
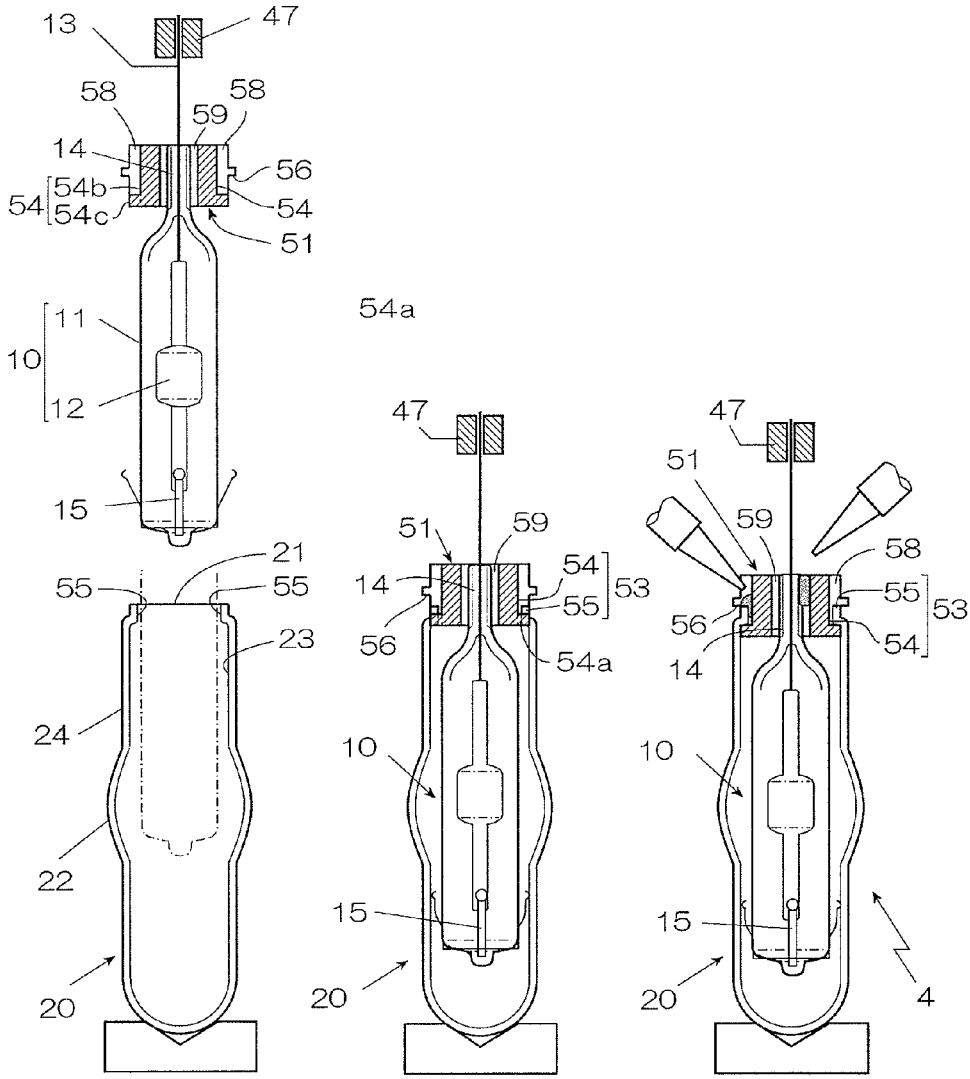
FIG. 9 is an explanatory view showing the step of assembly a light emitting tube and an outer bulb thereof.

When the lamp main body 10 and the outer bulb 20 are assembled, they are assembled, by mounting a support 15 to the top end of the lamp main body 10, externally fitting the attaching member 51 over the pinch seal 14, and situating the same with the top end being directed downward coaxially with an outer bulb 20 which is stood upright with the top end 21 being directed upward as shown in FIG. 9A, rotating the attaching member 51 relative to the outer bulb 20 in a state where it is inserted till a position where the flange 56 of the attaching member 51 is abutted against the opening end 21 of the outer bulb 20, engaging the concave portion 54 of the attaching member 51 and the engaging protrusion 55 of the outer bulb 20, and then lowering the and lamp main body further to such a position where the distance between the clamper 47 and the flange 56 reaches a predetermined size as shown in FIG. 9B.

Then, as shown in FIG. 9C, a heat resistant adhesive A is filled from the bottom of the attaching member 51 into the insertion hole 59 in a state where the clamper 47 and the flange 56 are retained at a distance of a predetermined size and an adhesive A is filled from the adhesive injection port 58 to the joint portion 53.

In this case, since a narrow portion is formed in the space on the side of the upper end of the joint portion 53 by the guide groove 54*a* and the horizontal engaging portion 54*c* of the engaging concave portion 54 formed to the outer peripheral surface 52 of the attaching number 51, the adhesive A cast into the joint portion 53 can be dammed so as not to overflow to the upper surface of the attaching member 51.

Thus, the lamp main body 10 and the outer bulb 20 are attached to the attaching member 51, and a partially completed lamp product 4 not yet mounted with the base main body 32 is manufactured. When inventory stocks are controlled in this state, since necessary lamps can be manufactured simply by merely mounting optional base main bodies in accordance with the quantity of products to fill an order, this causes no wasteful inventory stocks.

Finally, the partially completed lamp product 4 is attached to the metal main body 32.

Figure 10A:
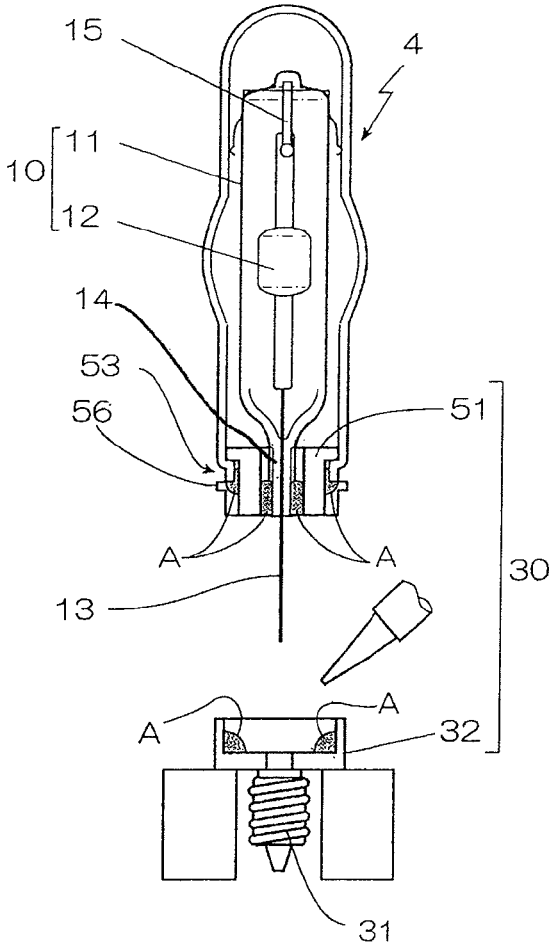
FIG. 10 is an explanatory view showing the step of mounting a base main body thereof.

First, as shown in FIG. 10A, an adhesive A is deposited to two inner corner portions of the base main body 32, the lead wire 13 is clamped downward, and a partially completed lamp product 2 is coaxially arranged with the base main body 32 and lowered vertically.

Figure 10B:
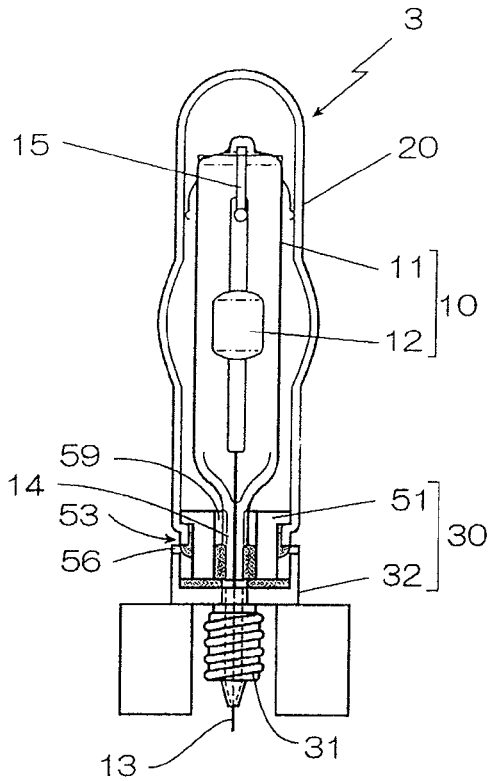

Then, as shown in FIG. 10B, at the instance the flange 56 abuts against the opening end of the base main body 32, the base main body 32 and the attaching member 51 are secured by means of the adhesive A.

At the same time, the top end of each of the lead wires 13 is guided into the contact terminal 31, the lead wire 13 and the contact terminal 31 are electrically connected from the outside by an optional method such as soldering and, if the lead wire 13 extends outward of the top end of the contact terminal 31, the extended portion is cut off to complete assembling.

Figure 8:
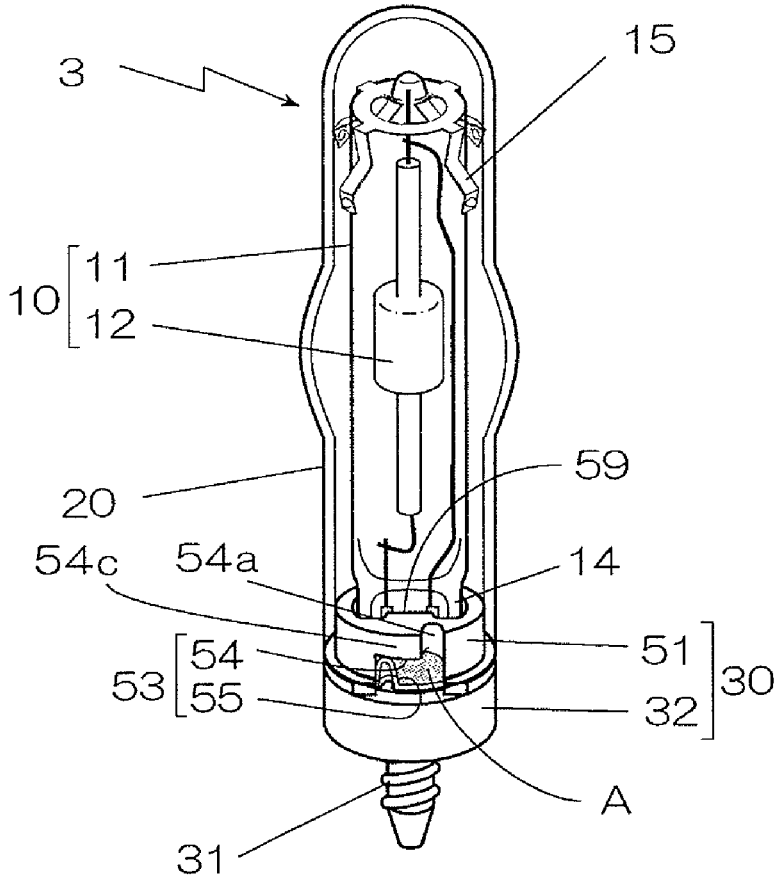
FIG. 8 is a completed perspective view thereof.

In the thus assembled lamp 3 with the outer bulb, as shown in FIG. 8, the adhesive A filled in the insertion hole 59 of the attaching member 51 for securing the lamp main body 10 is invisible externally and also the adhesive A for securing the outer bulb 20 is visible only for the portion where it is filled in the concave portions 54 formed at two circumferential positions, so that the lamp 4 is neat in view of design and has high commercial value.

Further, since the lead wire 13 is secured to the contact terminal 31 of the base main body 32 in a state where the pinch seal 14 of the lamp main body 10 is inserted through the insertion hole 59 of the attaching member 51, the attaching member is not detached from the base main body 32.

Further, since the outer bulb 20 is secured by means of the adhesive to the attaching member 51, and the engaging protrusion 55 of the opening end 21 thereof is directly caught by the engaging concave portion 54 formed to the attaching member 51, the outer bulb 20 is not detached when it is attached in a suspended state with the end thereof on the side of the base 30 being directed upward even if the adhesive strength of the adhesive A is lost.

Example 4

Figure 11:
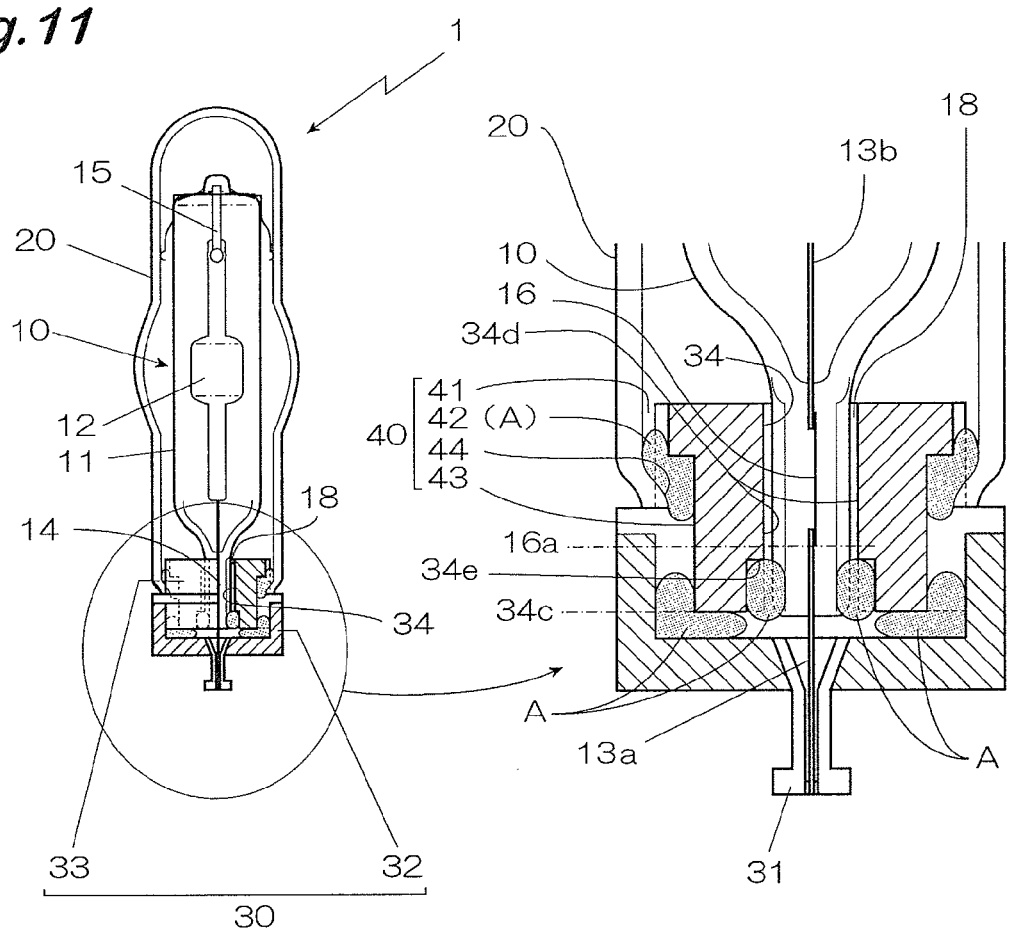
FIG. 11 is an exploded perspective view showing a further embodiment of a lamp with an outer bulb according to the invention thereof.
Figure 13A:
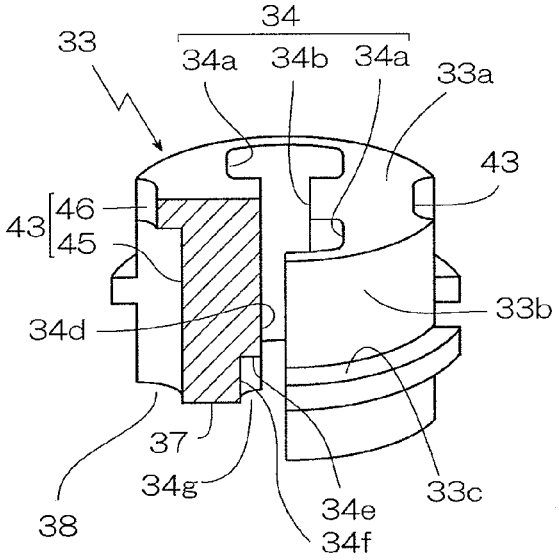
FIG. 13 is an enlarged cross sectional view showing the internal structure of an attaching member thereof.
Figure 13B:
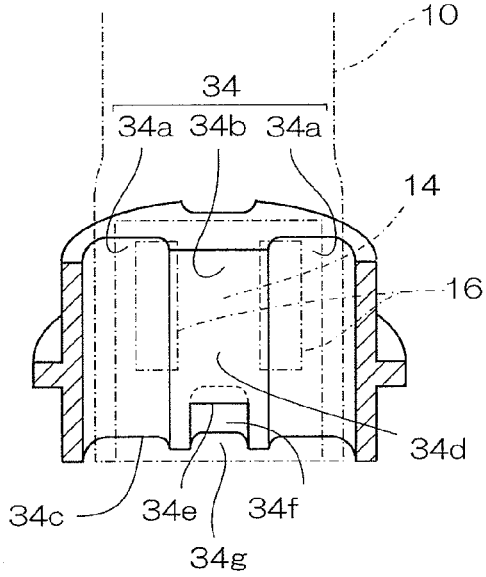
Figure 14:
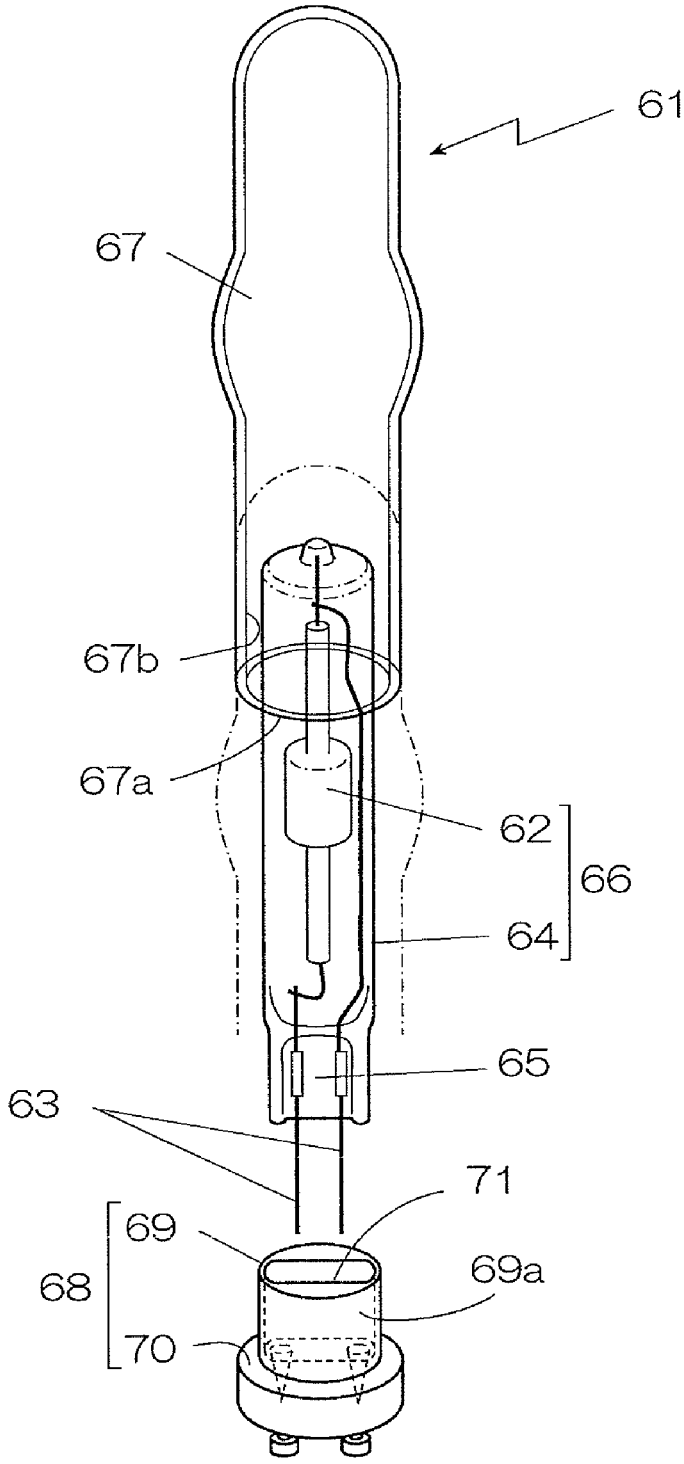
Fig. 14 (prior art)
FIG. 14 is an exploded perspective view of an existent device.
Figure 15:
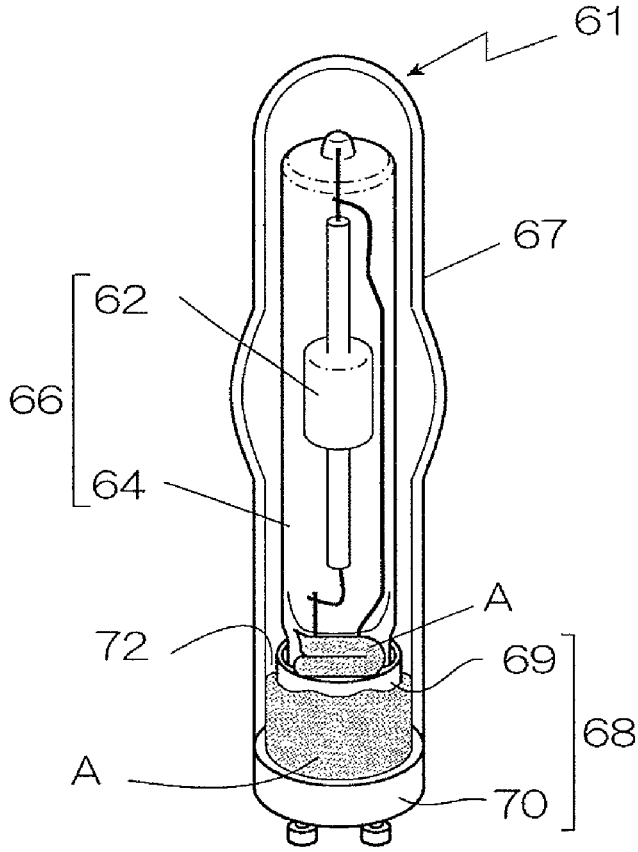
FIG. 15 is a completed perspective view of an existent device.
Figures 16A, 16B, 16C:
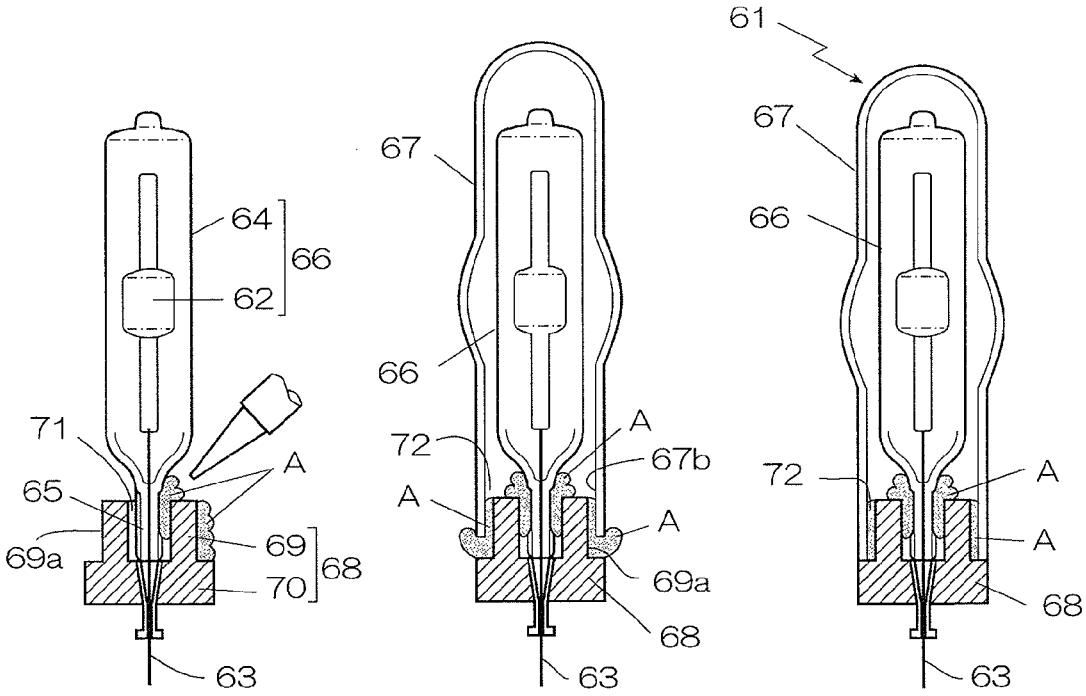
Fig.16(a) (prior art)
Fig.16(b) (prior art)
Fig.16(c) (prior art)
FIG. 16 is an explanatory view showing the step of assembling the existent device.

FIG. 11 to FIG. 13 show a further embodiment of a lamp with an outer bulb of the invention. Portions in common with those shown in FIGS. 1 to 10 carry same reference numerals for which detailed descriptions are to be omitted.

This example is identical with the examples described above except for forming an air cooling gap between a portion of a pinch seal where molybdenum foils are sealed and the inner wall surface of an insertion hole opposed thereto for dissipating heat conducted to the pinch seal thereby suppressing the temperature rise of the molybdenum foils during light emission.

In this example, an insertion hole 34 in an attaching member 33 of a base 30 is formed corresponding to the cross sectional shape of the pinch seal 14 such that a slit portion 34*b* of a narrow width for inserting a flat plate portion 14*b* is formed between a pair of flange insertion portions 34*a* of a relatively large width for inserting right and left flanges 14*a* and they are in communication with each other.

Further, a dam 34*e* is formed at a portion from the bottom opening 34*c* to a position oppose to the external lead weld end 16*a* of the molybdenum foil 16 for damming the adhesive A injected from the bottom opening 34*c* in a state where the pinch seal 14 is inserted in the insertion hole 34 of the attaching member 33 by a narrow portion for decreasing the gap between the inner wall surface 34*d* and the pinch seal 14 to less than the gap at the bottom opening 34*c*.

In this example, a concave portion 34*f* formed to the inner wall surface 34*d* in the insertion hole 34 is extended as far as the bottom opening 34*c* and the step is formed as the dam 34*e*, and an adhesive injection port 35 for a lamp main body 10 is formed to the bottom opening 34*c*.

Then, an adhesive A is injected from an adhesive injection port 34*g* opened at the bottom of the attaching member 33 to the lamp main body 10 in which the pinch seal 14 is inserted in the insertion hole 34, and filled in the concave portion 34*f*, whereby the adhesive A is filled in the concave portion 34*f* formed from the injection port 34*g* to the position opposing the external lead weld end 16*a* of the molybdenum foil 16, and the lamp main body 10 is secured to the attaching member 33.

In the state, since the adhesive A is not filled between the portion of the pinch seal 14 in which the molybdenum foil 16 is sealed and the inner wall surface 34*d* of the insertion hole 34 opposed thereto to define a gap, the gap functions as an air-cooling gap 18 for radiating the heat conducted from the light emitting tube 12 to the pinch seal 14 when the light emitting tube 12 is caused to emit light thereby suppressing the temperature rise in the molybdenum foil.

That is, the molybdenum foil 16 in the pinch seal 14 is not covered or the insertion hole 34 is not clogged by the adhesive A, whereby the air-cooling gap 18 formed between the molybdenum foil 16 and the inner wall surface of the insertion hole 34*d* opposing thereto is opened in the outer bulb 20, and convection is generated in the air-cooling gap 18 by air in the outer bulb 20 to air cool the pinch seal 14.

Accordingly, when the light emitting tube 12 emits light by electric supply to the lamp 1, since the heat conducted from the light emitting tube 12 to the pinch seal 14 is dissipated from the pinch seal 14 by the convection generated in the air-cooling gap 18, the pinch seal 14 is cooled and, as a result, temperature rise of the molybdenum foil 16 is suppressed.

This can suppress oxidation of the molybdenum foil and prevent disconnection at the molybdenum foil 16 to extend the working life of the lamp.

The constitution and the function and the effect of this example are identical with those of other examples except for forming the air-cooling gap 18.

Accordingly, when inventory stocks are controlled in the state of the partially completed lamp products where the lamp main body and the outer bulb 20 are attached to the attaching member 33 and the base main body 32 is not yet mounted, since necessary lamps can be manufactured simply by merely mounting optional base main bodies in accordance with the quantity of products to fill an order, this causes no wasteful inventory stocks.

Further, since the adhesive filled in the insertion hole 34 of the attaching member 33 is not visible externally, it is neat in view of design and has high commercial value.

Further, since the attaching member 33 is secured by means of the adhesive A to the base main body 32, and the lead wire 13 is secured to the contact terminal 31 of the base main body 32 in a state where the pinch seal 14 of the lamp main body 10 is inserted in the insertion hole 34 of the attaching member 33, the attaching member 33 is not detached from the metal main body 32.

Since the outer bulb 20 is secured by means of the adhesive to the attaching member 33, and the outer peripheral surface 33*b* of the attaching member 33 and the inner peripheral surface 23 of the outer bulb 20 are engaged to each other by the joint portion 40, the outer bulb 20 is not detached when it is mounted in a suspended state with the portion on the side of the base 30 being directed upward even when the adhesion strength of the adhesion A is lost.

INDUSTRIAL APPLICABILITY

As has been described above, the present invention is applicable to the application use for a lamp with an outer bulb in which an outer bulb for containing a lamp main body is attached.

REFERENCE SIGN LIST

1 lamp with an outer bulb
10 lamp main body
13 lead wire
13*a* external lead
13*b* internal lead
14 pinch seal
15 support
16 molybdenum foil
16*a* external lead weld end
18 air-cooling gap
20 outer bulb
21 opening end
30 base
32 base main body
33 attaching member
34 insertion hole
34*c* bottom opening
34*d* inner wall surface
34*e* dam
35 outer peripheral surface
36 flange
37 bottom
38 adhesive injection port
40 joint portion
41 gap
42 joint
43 concave portion
44 convex portion
3 lamp with an outer bulb
51 attaching member
52 outer peripheral surface
53 joint portion
54 engaging concave portion
55 engaging protrusion
56 flange
58 adhesive injection port
59 insertion hole

The invention claimed is:

1. A lamp with an outer bulb in which a lamp main body formed with a pinch seal by hot press bonding one end of an airtight bulb having a pair of lead wires led out therefrom is attached in a state housed in the outer bulb to a base, wherein the base includes a base main body having contact terminals electrically connected with a receptacle and an attaching member fitted to the inside of the base main body in a state of retaining the lamp main body and the outer bulb, the attaching member has an insertion hole formed therethrough for inserting and retaining the pinch seal and has a flange formed at the outer peripheral surface thereof for abutment with the opening end of the outer bulb end, a joint portion is formed for engaging the outer peripheral surface of the attaching member and the inner peripheral surface of the outer bulb, and an adhesive injection port is opened in the bottom of the attaching member opposed to the base main body for filling a joint adhesive to the joint portion in a state of attaching the outer bulb, a narrow portion is provided in the joint portion for inhibiting the joint adhesive, filled from the adhesive injection port, from overflowing through the joint portion toward the upper end of the attaching member.

2. A lamp with an outer bulb according to claim 1, wherein the joint portion comprises a concave portion or a convex portion formed to the outer peripheral surface of the attaching member and the inner peripheral surface of the outer bulb opposed thereto respectively while facing a gap formed between the outer peripheral surface of the attaching member and the opposed inner peripheral surface of the outer bulb, and a joint which is cast in-mold by the joint adhesive filled in the gap.

3. A lamp with an outer bulb according to claim 1, wherein the joint portion constitutes a bayonet mechanism comprising an engaging concave portion formed to the outer peripheral surface of the attaching member and an engaging protrusion formed to the outer bulb.

4. A lamp with an outer bulb according to claim 1, wherein a pair of molybdenum foils welded to a pair of lead wires led out from the lamp main body and a pair of internal leads for electric supply to the inside of the lamp main body and connecting them are airtightly sealed in the pinch seal, the lamp main body has a support made of a thin metal plate attached at the top end thereof for coaxially supporting the lamp main body to the outer bulb and the pinch seal thereof is inserted into the insertion hole of the attaching member, and an insertion hole adhesive is filled in the insertion hole for a portion from the bottom opening to a position opposed to the lead wire weld end of the molybdenum foil to secure the lamp main body to the attaching member, and an air-cooling gap is formed between a portion of the pinch seal where the molybdenum foil is sealed and the inner wall surface of the insertion hole opposed thereto for dissipating heat conducted to the pinch seal thereby suppressing the temperature rise of the molybdenum foil during light emission.

5. A lamp with an outer bulb according to claim 4, wherein a dam for damming the insertion hole adhesive injected from the opening at the bottom is formed in the inner wall surface of the insertion hole from the opening portion of the bottom to the position opposing the external lead weld end of the molybdenum foil by a narrow portion for decreasing the gap between the inner wall surface and the pinch seal to less than the gap in the opening portion at the bottom.

* * * * *